United States Patent [19]

von Beckmann

[11] 4,369,712

[45] Jan. 25, 1983

[54] RAILROAD TAMPING MACHINE

[75] Inventor: Helmuth von Beckmann, Columbia, S.C.

[73] Assignee: Canron Corporation, West Columbia, S.C.

[21] Appl. No.: 233,555

[22] Filed: Feb. 11, 1981

Related U.S. Application Data

[63] Continuation-in-part of Ser. No. 84,307, Oct. 12, 1979, Pat. No. 4,282,815.

[51] Int. Cl.[3] ..... E01B 27/014

[52] U.S. Cl. ..... 104/12

[58] Field of Search ..... 104/12, 7 B, 7 A, 7 R, 104/8, 10

[56] References Cited

U.S. PATENT DOCUMENTS

| | | | |
|---|---|---|---|
| 3,357,366 | 12/1967 | Plasser et al. | 104/12 |
| 3,534,687 | 10/1970 | Plasser et al. | 104/12 |
| 3,779,170 | 12/1973 | Plasser et al. | 104/12 |
| 3,797,397 | 3/1974 | Eisenmann et al. | 104/12 |
| 4,111,128 | 9/1978 | Keyes | 104/12 X |
| 4,258,627 | 3/1981 | Theurer | 104/12 |
| 4,282,815 | 8/1981 | von Beckmann | 104/12 |

*Primary Examiner*—Joseph F. Peters, Jr.
*Assistant Examiner*—M. J. Hill
*Attorney, Agent, or Firm*—Fisher, Gerhardt, Crampton & Groh

[57] ABSTRACT

A railroad tamping machine for tamping adjacent pairs of ties in which a pair of workheads each including a pair of tamping units associated with each of the ties can be moved vertically as a unit or independently of each other and wherein a selected set of tamping units associated with a single tie can be held in an inoperative position while the remaining tamping units work on the associated tie. In one embodiment, provision is made for adjustment of the pair of workheads laterally and longitudinally relative to the track direction to accommodate irregular rail and tie spacing as well as rail curvature such as that encountered in switch areas.

6 Claims, 7 Drawing Figures

Fig-5
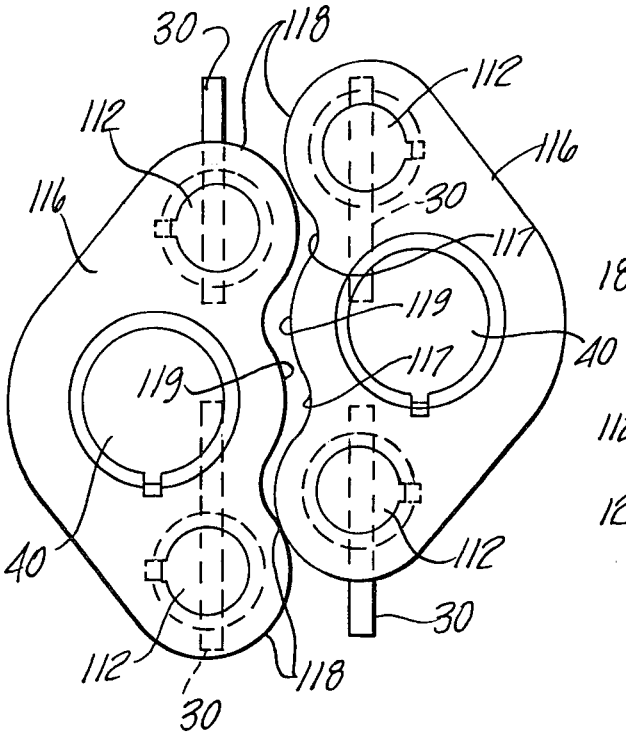
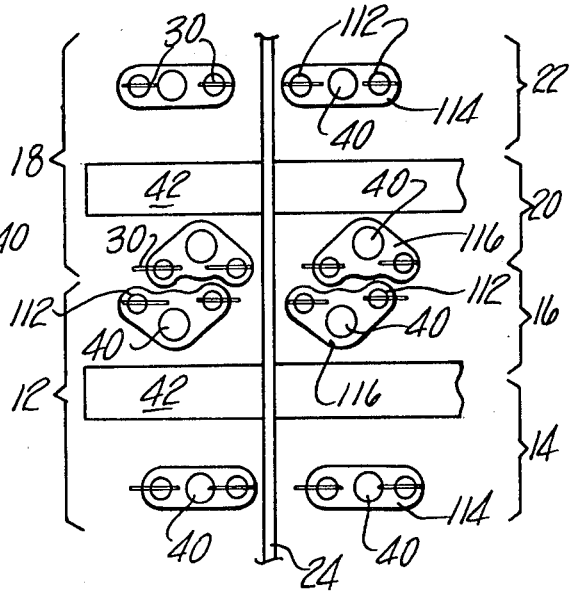
Fig-4
Fig-3
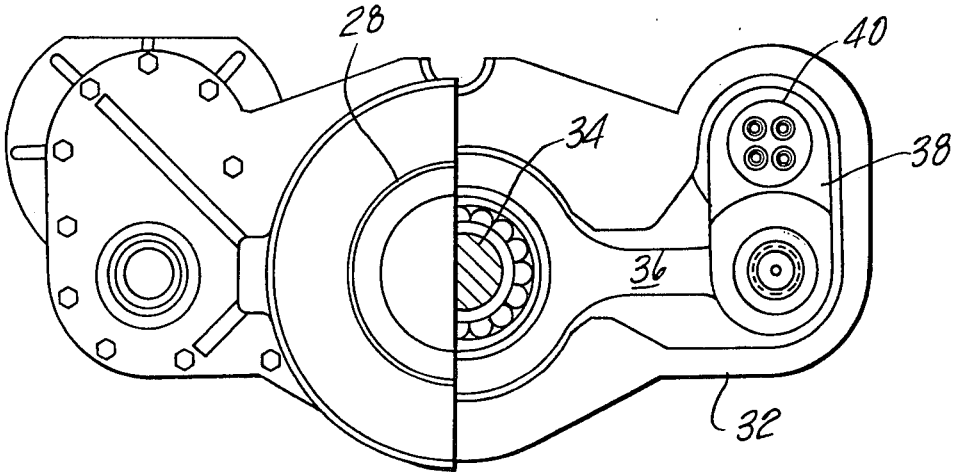

RAILROAD TAMPING MACHINE

This is a continuation-in-part application of co-pending application Ser. No. 84,307 filed Oct. 12, 1979 now U.S. Pat. No. 4,282,815 granted Aug. 11, 1981.

This invention relates to tamping devices for consolidating and tamping the ballast beneath ties of railroad tracks and more particularly to equipment for simultaneously working on adjacent ties and ties in switching areas.

It is highly desirable to provide railroad track maintenance equipment which will perform its function at a high rate of speed since maintenance time is limited by the amount of traffic on the track. In tamping equipment for consolidating and compacting the ballast under railroad ties, efforts have been made to tamp two ties simultaneously. In the prior art this has been accomplished by duplicating single tie tampers. However, because of size limitations, it has not been possible to place the single tamping units closely enough to tamp a pair of adjacent ties. For that reason single tie tamping units have required the tamping of ties spaced apart by at least one intervening tie. Prior art efforts to tamp adjacent ties have been limited to equipment in which the ballast engaging tamping tools are moved into position simultaneously and depend on the uniform spacing of ties. When ties are not spaced uniformly, such equipment must skip ties at least temporarily and thereafter employ a single tie tamping unit. The problems of tamping become even more complicated in switch areas because of the irregular spacing of rails and ties as well as the curvature of the rails and the angular relationship of the ties relative to the rails.

It is an object of the invention to provide a tamping machine for simultaneously tamping adjacent ties which makes provision for differently spaced ties.

Still another object of the invention is to provide a tamping machine for tamping adjacent ties simultaneously which also can be used to tamp a single tie.

It is another object of the invention to provide a tamping machine which is capable of tamping adjacent ties simultaneously and which also can be used to tamp ties in switch areas having irregular rail and tie spacing and track curvature.

The objects of the invention are accomplished by a railroad tamping machine which is mounted on a railroad vehicle for movement along the track and wherein the machine has a frame supporting two pairs of tamping units arranged longitudinally of a rail with the tamping units of each pair being disposed at opposite sides of one tie of a pair of adjacent ties. The tamping units of each pair are vibrated and at the same time are supported for swinging movement about horizontal axis toward and away from each other at opposite sides of a tie making it possible to consolidate and tamp ballast simultaneously relative to two adjacent ties. The pair of tamping units are supported relative to the vehicle for vertical movement simultaneously between transport and working positions and also to be moved vertically independently of each other. A selected one of the pair of tamping units may be held in an elevated, inoperative position while the other of the pairs of tamping units is operated to tamp the ballast associated with a single tie. The tamping units are off-set from each other in a direction transversely of a rail to permit adjacent tamping units to nest with each other and bring the tamping units into close proximity so that a maximum amount of movement of attached ballast engaging tools is obtained to consolidate ballast under ties supporting the rail. Provisions are made for movement of ballast engaging tools transversely of the rail to accommodate curves in the track and also to minimize the width of the tamping machine when it is being transported on a railroad track. In a second embodiment of the invention, provision is made for both lateral and longitudinal adjustment of the workheads to accommodate various irregularities of rail configuration as well as spacing of rails and ties of the type found in switch areas.

These and other objects of the invention will become apparent from the following description and from the drawings in which:

FIG. 3 is a view partially in section taken generally on line 3—3 in FIG. 2;

FIG. 4 is a diagrammatic view taken generally in the direction of line 4—4 in FIG. 1;

FIG. 5 is a view at an enlarged scale taken on line 5—5 in FIG. 1;

Figure 1:
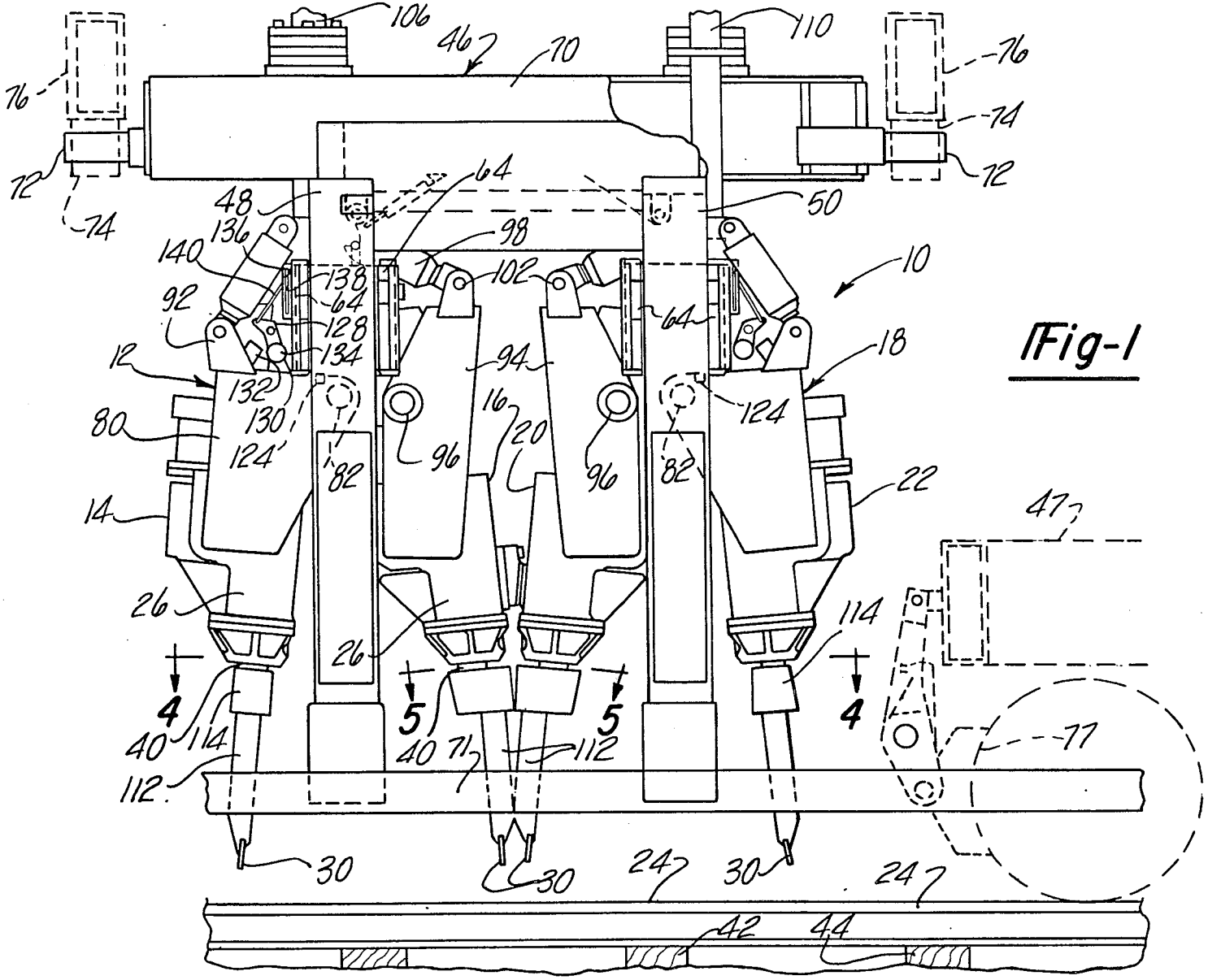
FIG. 1 is a side elevation of the tamping machine embodying the invention with associated parts supporting the machine being shown in broken lines.

Referring to the drawings, a tamping machine embodying the invention is designated generally at 10 and includes a forward workhead 12 which includes a pair of tamping units 14 and 16 and a rearward workhead 18 which includes a pair of tamping units 20 and 22. The workheads 12 and 18 are associated with one rail 24 at one side of the railroad track and an identical pair of workheads, not shown, are similarly disposed at the other side of the track.

Each of the tamping units 14, 16, 20 and 22 includes a pair of vibration heads 26 (FIG. 2) driven by a single electric induction motor 28. The vibration heads 26 are adapted to straddle the rail 24 and each drives ballast engaging tool elements 30.

Figure 2:
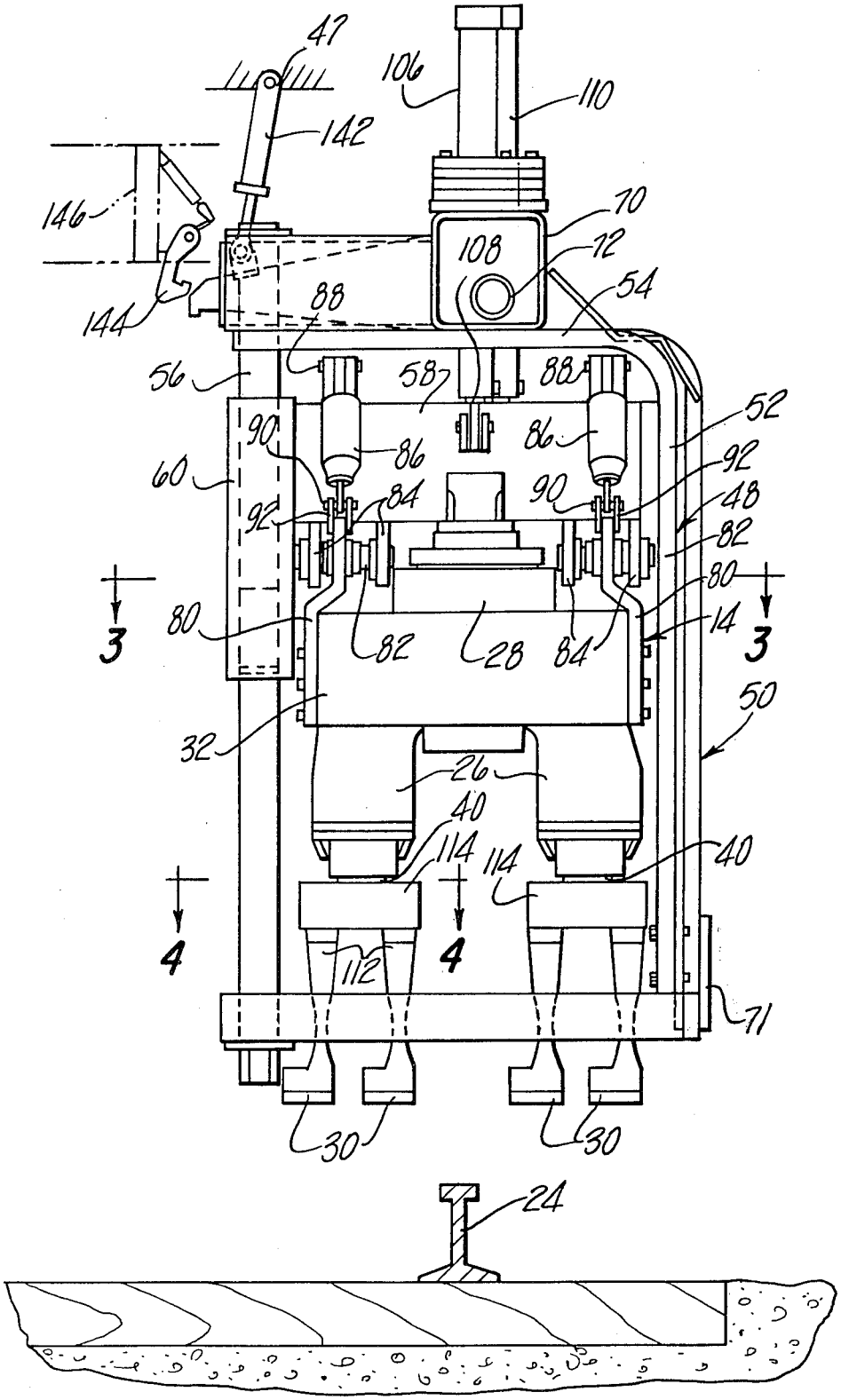
FIG. 2 is a front view as viewed from the left in FIG. 1.

The tamping units 14, 16, 20 and 22 are essentially the same and as best seen in FIGS. 2 and 3, each includes the induction motor 28 supported on top of a housing 32 forming a crank case. As seen in FIG. 3 the motor 28 drives a crank shaft 34 connected through the pair of connecting rods 36 each fastened to one end of a pair of rocker arms 38. The other end of the rocker arms 38 are connected to vibration shafts 40 disposed in the vibration heads 26 and supporting the tool elements 30 to be oscillated at a low amplitude and at a high frequency so that the ballast at opposite sides of ties 42 and 44 and also at the opposite sides of rail 24 is vibrated upon contact by the tool elements 30.

A mounting frame 46 by which the workheads 12 and 18 are supported relative to the rail 24 for movement between the transport position illustrated in FIG. 1 and 2 and a working position in which the tool elements 30 are immersed in ballast between ties is supported on a railroad vehicle as indicated at 47 and as disclosed, for example, in Patent 4,111,128. The frame 46 incorporates a pair of subframes 48 and 50 which are associated with the forward workhead 12 and rearward workhead 18, respectively. The subframe 48 includes a generally vertically extending outboard frame member 52 having its upper end merging with a horizontal frame member 54.

The inboard end of the horizontal frame member 54 is connected to a vertical guide member or rod 56. The vertical guide member 56 and outboard frame member 52 slidably support and guide a workhead carrier 58. The workhead carrier 58 includes a guide member 60 slidably mounted on the vertical guide rod 56 and has its outboard end guided for sliding movement on opposite sides of the outboard frame member 52 by guide element 64 which are best seen in FIG. 1.

The subframe 50 is substantially the same as the subframe 48 and the two subframes are joined together and held in fixed, spaced apart relationship by a carrier beam 70 extending in vertically elevated relationship to the rail 24 and a lower beam 71 outboard of rail 24. Beam 70 is provided with a pair of stub axles 72 at its opposite ends which are journaled in bearing 74 carried by horizontal frame members 76 extending generally transversely to the vehicle 47. Vehicle 47 is supported on rail engaging wheels, one being indicated at 77.

The tamping unit 14 is mounted relative to the subframe 48 by bracket members 80 which are rigidly mounted to opposite sides of the housing 32 and are pivoted on transversely aligned pins 82 each supported by bracket elements 84 rigidly fixed to the workhead carrier 58. Hydraulic actuators 86 are associated with the pair of bracket members 80, respectively, and each includes a cylinder pivotally connected to the workhead carrier by means of a pin 88. The rod end of the hydraulic actuator 86 is connected to the associated bracket member 80 by means of a transversely aligned pins 90 held in position by ears 92 mounted on the bracket members 80. Operation of the hydraulic actuators 86 is effective to swing the tamping unit 14 about the axis of the pivot pins 82.

Referring to FIG. 1, the tamping unit 16 adjacent to the tamping unit 14 and forming part of the forward workhead 12 is supported relative to the carrier 58 by a pair of bracket members 94 shaped somewhat differently than the bracket members 80 but similarly connected to the workhead carrier 58 for pivotal movement about pivot pins 96. Pivoting is accomplished by means of hydraulic actuators 98 disposed in a manner similar to the actuators 86 extending between workhead carrier 58 and pivotally connected to bracket 94 by means of pivot pins 102.

The motors 28 of each of the tamping units 14 and 16 are displaced forwardly or to the left as viewed in FIG. 1 relative to a transverse plane passing through vibration heads 26 and associated vibration shafts 40.

Simultaneous operation and extension of the hydraulic actuators 86 and 98 causes the tamping units 14 and 16 to swing about their respective pivot axis 82 and 96 from the position in FIG. 1 to cause a squeezing or squeeze-in action toward the tie 42.

The tamping units 14 and 16 making up the forward workhead are raised and lowered vertically as a unit relative to the frame 46 by means of a hydraulic cylinder 106 having its cylinder mounted on the beam 70 and its rod end 108 (FIG. 2) connected to workhead carrier 58.

The rearward workhead 18 is generally similar to the forward workhead 12 except that it is a mirror image thereof, that is, the housings of the motors 28 extend rearwardly relative to the transverse plane passing through the vibration heads 26 and associated vibration shafts 40. Another difference between forward and rearward workheads 12 and 18 can best be visualized by referring to FIG. 2 which illustrates that the subframe 50 of the rearward workhead 18 with its associated hydraulic actuator 110 is located farther to the right than the subframe 48 and hydraulic actuator 106 of the forward workhead 12. Such an off-set relationship permits the adjacent tamping units 16 and 20 to be brought into close proximity with each other at the beginning of a tamping cycle to be later described.

The tool elements 30 each include a generally vertically extending tool shank 112. As seen in FIG. 2, a pair of tool shanks 112 is supported by a tool holder 114 one of which is fixed to the bottom of each of the pair of vibration shafts 40 forming part of the tamping unit 14. The associated ballast engaging tool elements 30 are off-set to one side of the shanks 112 and transversely of the rail 24 as best seen in FIG. 2.

The tamping unit 22 is provided with an identical tool holder 114 which receives tool shanks 112 to support ballast engaging tool elements 30. In this instance, however, the tool elements 30 are off-set transversely of the rail 24 in the opposite direction from the tool elements 30 associated with the tamping unit 14 as best seen in FIG. 4.

The tamping units 16 and 20 which are positioned adjacent to each other are provided with tool holders 116 that are different than the tool holders 114 of the tamping units 14 and 22 at the forward and rearward extremeties of the tamping machine 10. As best seen in FIG. 5, the tool holders 116 are generally triangular in shape with an irregular base portion having indentations 117 formed by protrusions 118 which are generally concentric with tool shanks 112 and a central protrusion 119 concentric with the pair of vibration shafts 40 of each tamping unit 16 and 20. As best seen in FIG. 1, this permits the tool elements 30 of the adjacent tamping units 16 and 20 to be brought very closely together at the beginning of the tamping cycle and the tool shanks 112 can overlap with the associated tool elements 30 extending transversely in opposite direction from the associated tool shanks 112. As seen in FIG. 5, the work faces of the tool elements 30 of the adjacent tool holders 116 extend transversely in opposite directions but are substantially aligned longitudinally of the tamping machine 10.

An examination of FIG. 4 makes it apparent that the off-set aspects of the workhead 12 and 18 makes it possible for the tool holders 116 of the tamping unit 16 and 22 to nest together to bring the tool elements 30 closely togther and that the tool shanks 112 of the tamping units 16 and 20 also are off-set to facilitate movement into close proximity at the beginning of the tamping cycle. Although the tool elements 30 of adjacent tamping units 14, 16, 20 and 22 extend in opposite directions from each other it will be noted that all of the working surfaces of all of the tool elements 30 are substantially aligned in a longitudinal direction parallel to the rail 24.

Each of the workheads 12 and 18 can be moved vertically either simultaneously as a unit or completely independently of each other. In some instances it may be desirable to operate only one of the tool workheads in which case the idle workhead can be retained in its elevated transport position by means of a hook 120 which can be seen in FIG. 6. The hook 120 engages a pin 121 to prevent downward vertical movement of the workhead 12. When it is desired to place the workhead 12 in condition to be lowered, the hook 120 can be pivoted relative to pin 121 by means of a hydraulic actuator 122 having one end connected to the beam 70 and the other end connected to the hook 120. A similar lock arrangement incorporating a hook 120 and pin 121 can be provided for the rearward workhead 18 but is not shown in the drawing.

The beginning of the tamping cycle of the tamping machine 10 begins with both of the workheads 12 and 18 in their elevated position as illustrated in FIG. 1 and with the tool elements 30 of the adjacent tamping unit 16 and 20 positioned in close proximity with each other as determined by a bumper member 123 mounted on the tamping unit 16 and engaging the tamping unit 20. The tamping machine 10 is disposed so that the tool elements 30 of the tamping units 16 and 20 are disposed midway between the adjacent ties 42 and 44. Actuation of typical hydraulic controls, not shown, operates the hydraulic cylinders 106 and 110 to simultaneously lower the forward and rearward workheads 12 and 18 to immerse the tool elements 30 in the ballast forming a bed for the ties 42 and 44. In addition to the weight of the tamping units, pressure can be exerted by the hydraulic actuators 106 and 110 to force the tool elememts into the ballast. The depth to which the tool elements 30 are immersed can be determined by limit switches indicated at 124 and associated with each of the subframes 48 and 50 to be engaged by movement of the workhead carriers 58.

With the tool elements 30 immersed in the ballast, extension of all of the hydraulic actuators 86 and 98 associated with the tool workheads 12 and 18 results in pivoting of the tamping units about their pivots 82 and 96 so that the tool elements 30 of each workhead pivot, swing or are squeezed-in toward each other. The rate of such squeeze-in is variable and can be predetermined and selected to suit ballast conditions. Hydraulic communication between the actuators 86 and 98 assures uniform squeeze pressure since squeeze-in can be brought to a halt when a present hydraulic pressure is reached due to the pressure build up between opposing tool elements 30. Squeezing of the tool elements 30 towards each other at opposite sides of the ties 42 and 44 results in consolidation of the ballast under the ties.

Actuation of the hydraulic cylinders 106 and 110 initiates the up-feed portion of the tamping workheads 12 and 18 in the tamping cycle in which the tool elements 30 of a given workhead 12 or 18 remained in relatively fixed position to each other. This raises the tool elements 30 vertically upwardly along the opposite sides of the associated tie. When the tool elements 30 clear the upper level of the ballast, the hydraulic actuators 86 and 98 can be returned toward their retracted position so that the tamping units 14, 16 and 20, 22 are returned to their maximum open position and to a preselected upper elevated position in preparation for the next cycle of operation when the machine 10 is moved to the next pair of adjacent ties.

To accommodate variation in tie spacing, provision is made for limiting the position to which the tamping units 14 and 22 can swing about their pivot pins 82 upon retraction of the hydraulic cylinders 86. For any given spacing of ties such as 42 and 44, the tool elements 30 of the tamping units 16 and 20 are disposed at a midpoint between the ties. It then becomes desirable to set the initial position of the tamping units 14 and 22 to reflect the spacing of ties so that the associated tool elements of tamping units 14 and 22 are spaced the same distance from the opposite sides of the ties 42 and 44 as the tool elements 50 disposed between the ties. This is accomplished by an adjusting arrangement which includes an arm 128 mounted on the workhead carrier 58 and held in a selected angular position by an adjustable knob 130. Upon outward swinging movement of the tamping units 14 and 22 about their respective pivots 82, a stop member 132 on ear 92 comes into engagement with a proximity switch 134 located on the end of the adjusting arm 128. This actuates the appropriate controls, (not shown), to prevent further outward swinging movement by way of the hydraulic cylinders 86. The desired adjustment is preferably made when the tamping units are immersed in the ballast. Thereafter adjustment by loosening the knob 130 and moving the arm 128 can be accomplished to a preselected position. The position of the arm 128 is transferred to an indicator 136 movable in a slot. The indicator 136 is at the end of a link 140 pivotally connected to the adjustable lever 128. After the arm 128 is rotated to a selected position, the knob is locked. Thereafter when the tamping cycle is resumed, the tamping workheads will move upwardly vertically and the tamping units 14, 16 and 20, 22 will swing outwardly until a proximity switches 134 associated with units 14 and 22 are engaged at which time further outward swinging movement stops. In this manner it makes it possible for an operator to select the maximum outward position of the tamping units 14 and 22 in accordance with the tie spacing of the railroad track which is to be worked.

Typically the tie spacing for a given linear distance of railroad track may remain relatively uniform so that both of the workhead units 12 and 18 may be operated simultaneously to tamp two ties at the same time. If, however, it occurs that a tie is encountered which has a different spacing, it is unnecessary to skip that tie and the tamping cycle for a single tie can be conducted by disabling a selected one of the workheads 12 or 18. This is accomplished by employing the hook 120 and engaging it with the pin 121 of the workhead which is to be placed in inoperative condition.

After a single tie is tamped and the usual tie spacing is again encountered, both of the workheads 12 and 18 can be operated simultaneously on pairs of adjacent ties.

Under certain circumstances, such as when the track 24 is curved, tamping of ties can be accommodated. Under such circumstances it becomes necessary to shift the tool elements 30 laterally. A limited amount of such lateral shifting can be accomplished by pivoting the workheads 12 and 18 simultaneously with the frame 46 by swinging the machine 10 transversely about the axles 72 extending from the ends of beam 70. As seen in FIG. 2 this is accomplished by a hydraulic actuator 142 having one end connected to a point on the frame 46 spaced inwardly of the shafts 72. The opposite ends of the hydraulic cylinder is pivotally mounted to a point on the frame of the vehicle 47 transporting the machine 10.

In the transport position, when the workheads 12 and 18 are in their elevated position, it is often desirable to swing the machine 10 so that the lower position is moved inwardly of the railroad track. This also is accomplished by activating the hydraulic actuator 142 to swing the machine 10 in a clockwise direction relative to the axle 72 as viewed in FIG. 2. After swinging movement of a few degrees from the vertical, a hook member 144 pivoted on the vehicle 47 from a central, longitudinal beam 146 can be moved by means of a hydraulic actuator 148 to place the hook 144 in engagement with a complementary hook 150 fixed relative to the machine 10. This will hold the entire frame 46 in its tilted position while the vehicle 47 is moved over the track.

Although the machine 10 has been described in terms of the apparatus associated with one rail 24 of the railroad track it will be understood that a duplicate machine is transversely aligned to operate on the other track in such a manner that adjacent ties are operated on at both sides of the track. Also in the event of unusual tie spacing either the forward or rearward set of workheads associated with the pair of rails of a railroad track can be disabled while a single pair of workheads is operated to tamp a single tie.

Figure 6:
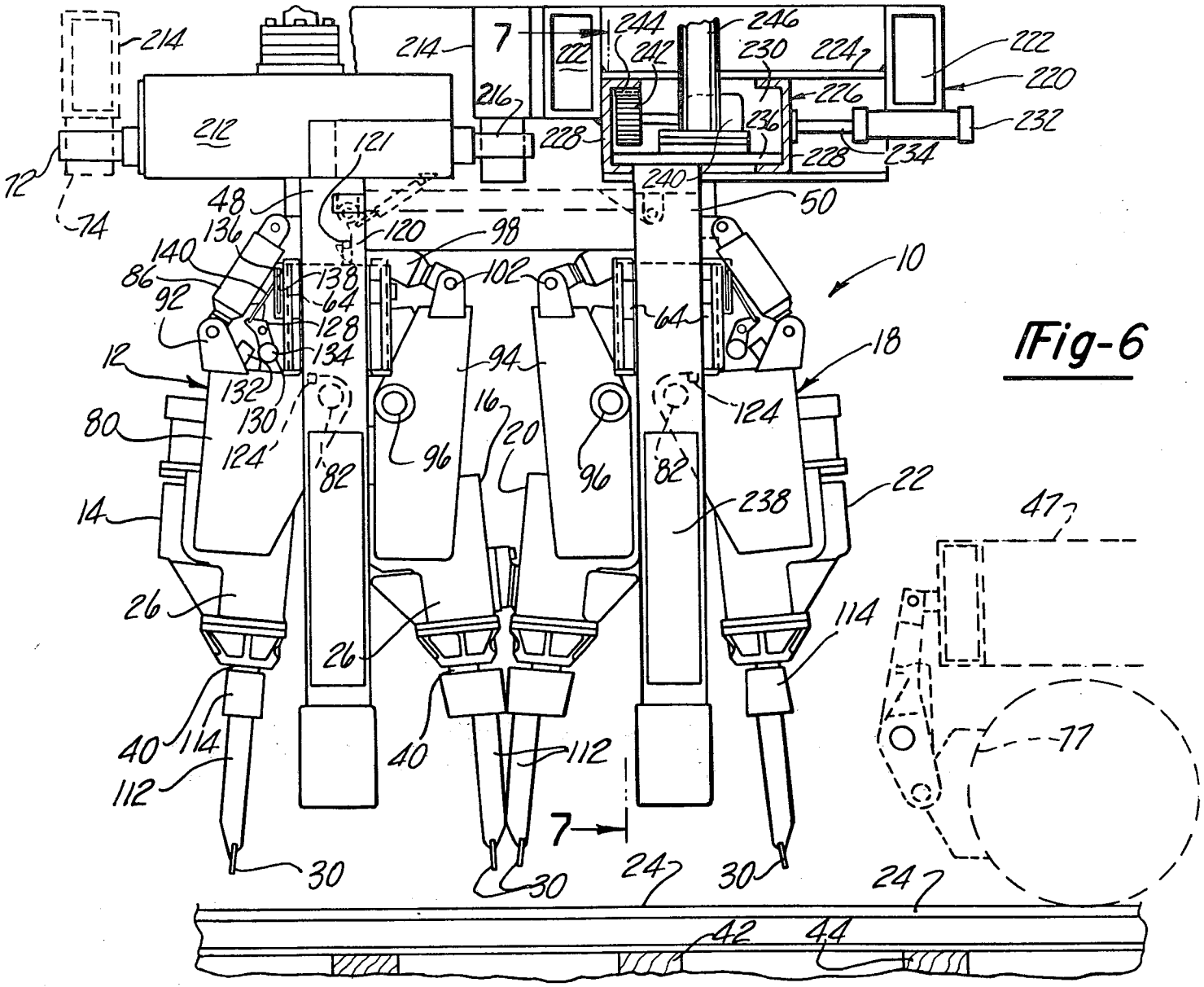
FIG. 6 is a side elevation similar to FIG. 1 but showing another embodiment of the invention.
Figure 7:
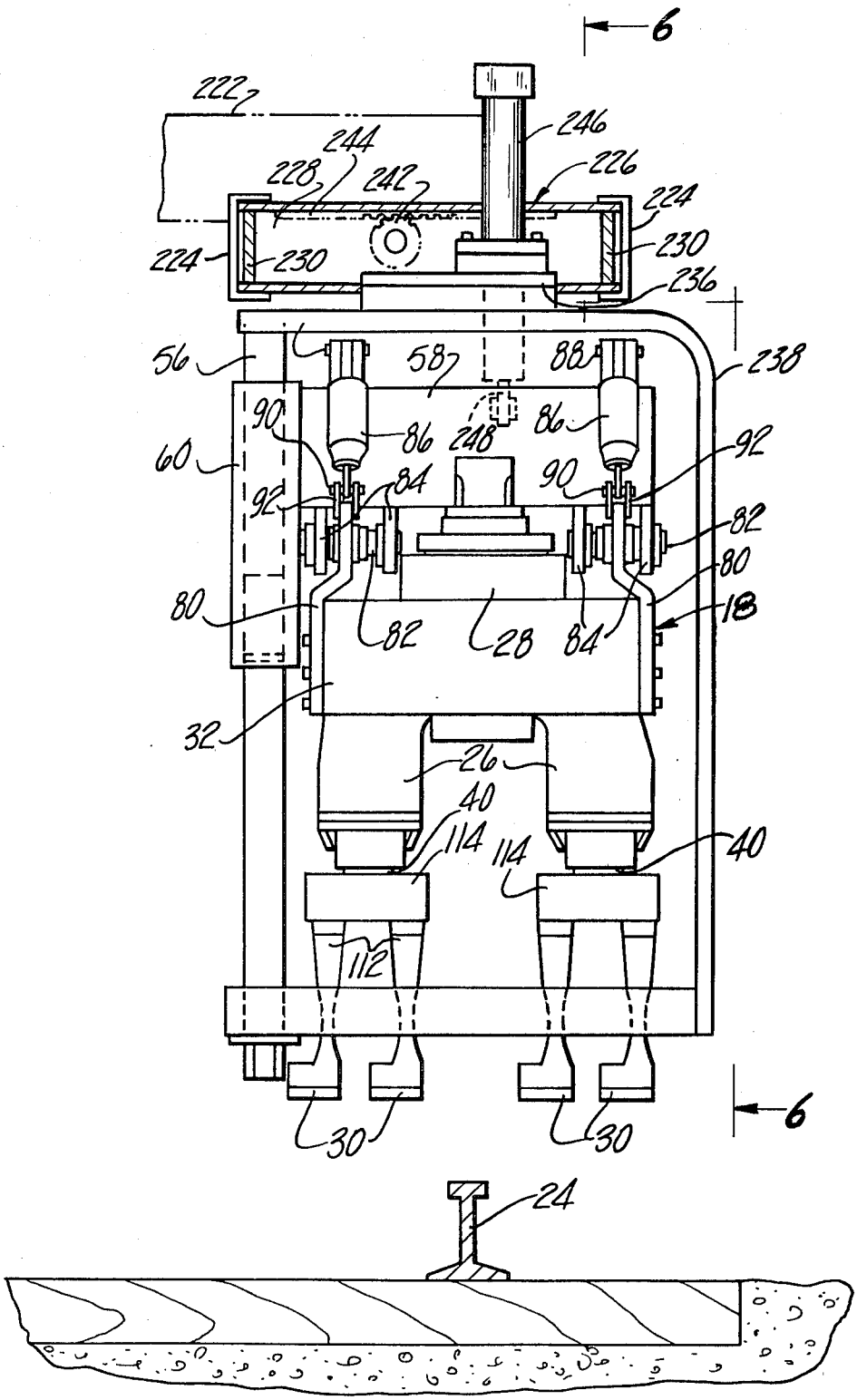
FIG. 7 is a view taken generally on line 7—7 in FIG. 6.

Referring now to FIGS. 6 and 7, another embodiment of the invention is shown which is adapted to be used in switch areas where the spacing of ties and a lateral separation of the rails may vary greatly. Additionally, the angular relationship of the ties relative to the rails and the curvature of the rails may be very irregular. In this embodiment of the invention, provision if made for a greater lateral adjustment of the tamping heads than can be accommodated by pivoting of the longitudinal beam 70. Also, provision is made for longitudinally spacing the workheads associated with each of the rails making it possible to use a single piece of equipment for working on a variety of the problems encountered in maintaining railroad track.

The embodiment of the invention illustrated in FIGS. 6 and 7 is identical in many respects to the earlier embodiment except for the manner in which the workheads 12 and 18 are suspended. The forward workheads 12 is mounted on the subframe 48 which is suspended from a short carrier beam 212 which is supported relative to transverse frame members 214 for pivotal movement about stub axles 72 and 116. In all other major respects, the workhead 12 is constructed and operates in the same manner as in the earlier embodiment of the invention.

The rear workhead 18 is the same in many respects as the workhead 18 except for the manner in which it is suspended and supported from the railroad vehicle indicated at 47. The supporting frame 220 for workhead 18 includes a pair of transverse beams 222 from which longitudinally extending and facing channel members 224 are supported. The longitudinally extending channel members 224 act as guide members and tracks for a carriage 226 which is generally rectangular and includes a pair of facing channels 228 held in spaced relation by side frame members 230. The carriage 226 can be moved longitudinally of the beams 224 by means such as a hydraulic actuator 232 mounted on the frame 220 and having its rod end 234 connected to the carriage 226.

The carriage 226 slidably supports a base member 236 to which the subframe 238 of the rear workhead 18 is fastened. Provision is made for moving the base member 236 relative to the carriage member 226 by way of an electric motor 240 mounted on the base member 236 to drive a pinion 242 in mesh with a toothed rack 244 fixed to one of the channels 228. A hydraulic actuator 246 is supported on the base member 236 and has its reciprocating rod 248 connected to the workhead 218 as seen in FIG. 7 to move the workhead 18 between the working and non-working positions.

Under many conditions of working on a railroad track, the operation of the machine 210 is the same as the machine 10 in that when the tie spacing remains relatively uniform over a given linear distance, the forward workhead 12 and the rearward workhead 18 can be operated to tamp adjacent pairs of ties simultaneously. Under conditions in the area of switches or where tie spacing is irregular or the angular disposition of the ties relative to the track varies, the rearward workhead 18 can be moved horizontally, longitudinally and transversely of the track 224 and relative to the forward workhead 12. Such longitudinal movement is accomplished by use of the hydraulic actuator 232 or lateral movement is accomplished by energizing the electric motor 240 to properly place the workhead 218 relative to a tie. Thereafter the forward workhead 12 and the rearward workhead 18 can be operated simultaneously. Also if desired, the forward workhead 12 can be moved to an inoperative position and maintained in that position by employing the hook 120 and engaging it with the pin 121 to hold the subframe 48 in elevated position.

It will be understood that an identical workhead arrangement 18 is associated with the other track 24 of a pair of tracks and that the pair of workheads 18 associated with the pair of tracks can be moved horizontally independently of each other both laterally and longitudinally The railroad tamping machine has been provided wherein a pair of workheads are mounted on a railroad vehicle for movement along the track in which the workheads are supported for independent vertical movement relative to each other so that each workhead can work on a separate tie. The workheads are arranged so that adjacent tamping units of each of the workheads can be closely spaced to each other at the beginning of the tamping cycle to achieve a maximum amount of movement toward respective ties for consolidation of ballast under the ties. The close spacing of adjacent tamping units is achieved by off-setting the pair of workheads transversely of the railroad track, by off-setting the ballast engaging tool elements transversely of their supporting shanks so that longitudinally adjacent tool elements are off-set in opposite directions from each other. The arrangement is such that two adjacent ties can be worked on simultaneously or if desired a selected single tie may be tamped. In addition, provision is made for lateral shifting of the tool elements to accommodate track curvature. In a second embodiment of the invention, provision is made for both lateral and longitudinal adjustment of the workheads to accommodate various irregularities of rail configuration as well as spacing of rails and ties of the type found in switch areas.

The embodiments of the invention in which an exclusive property or privilege is claimed are defined as follows:

1. A railroad tamping machine mounted on a railroad vehicle for movement along a railroad track comprising: a pair of longitudinally spaced workheads each including a pair of tamping units arranged longitudinally of a rail of a railroad track with said pair of tamping units of each workhead being disposed at opposite sides of one tie of a pair of adjacent ties, one tamping unit of each of said workheads being disposed between adjacent ties, said pair of tamping units of each workhead being supported for swinging movement toward and away from each other about horizontal transverse axes and at opposite sides of an associated tie, said workheads being supported relative to said vehicle for vertical movement simultaneously and independently of each other, one of said workheads being supported for independent horizontal lateral movement to selected positions relative to the other of said workheads, said vehicle and said rail, and means to hold said other of said pair of workheads in an elevated inoperative position.

2. The railroad tamping machine of claim 1 wherein said workheads of said pair of workheads are supported on said vehicle for movement longitudinally of each other.

3. The railroad tamping machine of claim 2 wherein one of said workheads is longitudinally stationary relative to said vehicle and the other of said workheads is movable longitudinally of said vehicle to selected positions.

4. A railroad tamping machine mounted on a railroad vehicle for movement along a railroad track comprising: a pair of longitudinally spaced workheads each including a pair of tamping units arranged longitudinally of a rail of a railroad track with said pair of tamping units of each workhead being disposed at opposite sides of one tie of a pair of adjacent ties, one tamping unit of each of said workheads being disposed between adjacent ties, said pair of tamping units of each workhead being supported for swinging movement toward and away from each other about horizontal transverse axes and at opposite sides of an associated tie, said workheads being supported relative to said vehicle for vertical movement simultaneously and independently of each other, one of said workheads being supported for longitudinal movement horizontally to selected position relative to said vehicle and to the other of said pair of workheads, and means to selectively hold said other of said pair of workheads in an elevated inoperative position.

5. The railroad tamping machine of claim 4 wherein said workheads of said pair of workheads are supported on said vehicle for movement laterally of each other.

6. A railroad tamping machine as set forth in claim 4 and further comprising an additional pair of workheads, each workhead including an additional pair of tamping units, said additional pair of workheads being supported relative to said vehicle for vertical movement in a horizontal direction simultaneously and independently of each other and relative to said first mentioned pair of workheads, one of said additional workheads being supported for horizontal longitudinal movement to selected positions relative to said vehicle and to the other of said pair of workheads independently of said first named workheads.

* * * * *

UNITED STATES PATENT AND TRADEMARK OFFICE

CERTIFICATE OF CORRECTION

PATENT NO. : 4,369,712

DATED : January 25, 1983

INVENTOR(S) : Helmuth Von Beckman

It is certified that error appears in the above—identified patent and that said Letters Patent is hereby corrected as shown below:

Column 7, line 18, "if" should read --is--.

Signed and Sealed this

Twentieth Day of September 1983

[SEAL]

*Attest:*

GERALD J. MOSSINGHOFF

*Attesting Officer*

*Commissioner of Patents and Trademarks*